US006082713A

United States Patent [19]

King

[11] Patent Number: 6,082,713

[45] Date of Patent: Jul. 4, 2000

[54] STEAM INJECTION HEATER

[75] Inventor: Leonard Tony King, Long Beach, Calif.

[73] Assignee: Komax Systems, Inc., Wilmington, Calif.

[21] Appl. No.: 09/165,665

[22] Filed: Oct. 3, 1998

[51] Int. Cl.[7] ..... B01F 3/04

[52] U.S. Cl. ..... 261/79.2; 261/DIG. 10; 261/DIG. 76

[58] Field of Search ..... 261/79.2, 127, 261/156, DIG. 10, DIG. 76

[56] References Cited

U.S. PATENT DOCUMENTS

| | | | |
|---|---|---|---|
| 1,158,231 | 10/1915 | Kerr | 261/79.2 |
| 2,455,498 | 12/1948 | Kern . | |
| 3,284,169 | 11/1966 | Tominaga et al. | 261/79.2 |
| 3,652,061 | 3/1972 | Chisholm . | |
| 3,844,721 | 10/1974 | Cariou et al. | 261/79.2 |
| 3,912,469 | 10/1975 | Ewan et al. | 261/79.2 |
| 3,923,288 | 12/1975 | King . | |
| 3,984,504 | 10/1976 | Pick . | |
| 4,141,701 | 2/1979 | Ewan et al. | 261/DIG. 76 |
| 4,674,888 | 6/1987 | Carlson . | |
| 5,395,569 | 3/1995 | Badertscher et al. | 261/DIG. 76 |

FOREIGN PATENT DOCUMENTS

| | | | |
|---|---|---|---|
| 0006734 | 1/1980 | European Pat. Off. | 261/79.2 |
| 693612 | 11/1930 | France | 261/DIG. 76 |
| 1607853 | 11/1990 | U.S.S.R. | 261/79.2 |

*Primary Examiner*—C. Scott Bushey
*Attorney, Agent, or Firm*—Malcolm B. Wittenberg

[57] ABSTRACT

A steam injection heater for liquids. The liquids are carried by a conduit characterized as having an upstream end, downstream, substantially circular cross-section and tapered section. A steam inlet pipe is caused to pass through a side wall of the conduit for injecting steam at its outlet proximate the longitudinal axis of the conduit upstream with the tapered section. The steam inlet pipe further includes a mixing element of a configuration to cause steam emanating from the steam inlet pipe to enter the conduit as a rotating cone of steam for efficiently transferring heat energy from the steam to the moving stream of liquids.

7 Claims, 3 Drawing Sheets

STEAM INJECTION HEATER

TECHNICAL FIELD OF THE INVENTION

The present invention is directed to a highly efficient steam injection heater for the heating of liquids moving within a conduit. The present invention is particularly effective in heating liquid food products as the invention is capable of a highly efficient transfer of heat energy from steam to the food products in a sanitary and safe environment. The present invention employs no moving parts and yet more efficiently facilitates the heating of a fluid stream by steam injection than any comparable device of its kind.

BACKGROUND OF THE INVENTION

Steam injection has been a unit operation carried out by chemical engineers in processing facilities for as long as chemical engineering has been a science. For example, a typical steam injection water heater was disclosed in U.S. Pat. No. 2,455,498. Subsequently, U.S. Pat. No. 3,984,504 dealt with the fabrication of a rather complex device used to eliminate water hammer which has characterized steam injection systems in the past. It was recognized that such heaters worked satisfactorily at relatively low steam pressure such as at pressures below 300 psi. At high steam pressures, however, water hammer develops in the system due to the sudden collapse of relatively large steam bubbles which are created by the high pressure steam as it condenses within the water.

Steam injection has also been viewed as a preferred expedient in the heat transfer from a first fluid to a moving stream of a liquid food product. Liquid food products oftentimes must be heated for sterilization and other purposes in an environment which maintains the integrity of the food product free of contamination from the heat source.

The heating of liquid food products presents further complications which are not present in the mere heating of a stream of water. Specifically, food products are generally of a viscous inconsistent consistency which would tend to clog any system containing complex parts which might otherwise be used in an efficient steam injection system. However, it is recognized that the introduction of steam to a moving liquid body represents an efficient heat transfer protocol. As such, it has been the object of the present invention to provide a device which is simple in construction, virtually clog-free, containing no moving parts and which is more efficient in the transfer of heat energy than comparable devices of its kind.

These and further objects will be more readily appreciated when considering the following disclosure and appended claims.

SUMMARY OF THE INVENTION

The present invention is directed to a steam injection heater for liquids comprising a conduit for carrying a moving stream of liquids from an upstream end to a downstream end thereof. The conduit is characterized as having a substantially circular cross-section, longitudinal axis and tapered section. The steam injection heater further comprises a steam inlet pipe passing through a side wall of the conduit for injecting steam at its outlet proximate the longitudinal axis of the conduit upstream from the tapered section.

The steam inlet pipe further includes a mixing element. The mixing element is of a configuration to cause steam emanating from the steam inlet pipe to enter the conduit as a rotating cone of steam for efficiently transferring heat energy from the steam to the moving stream of fluid.

DETAILED DESCRIPTION OF THE INVENTION

Figure 1:
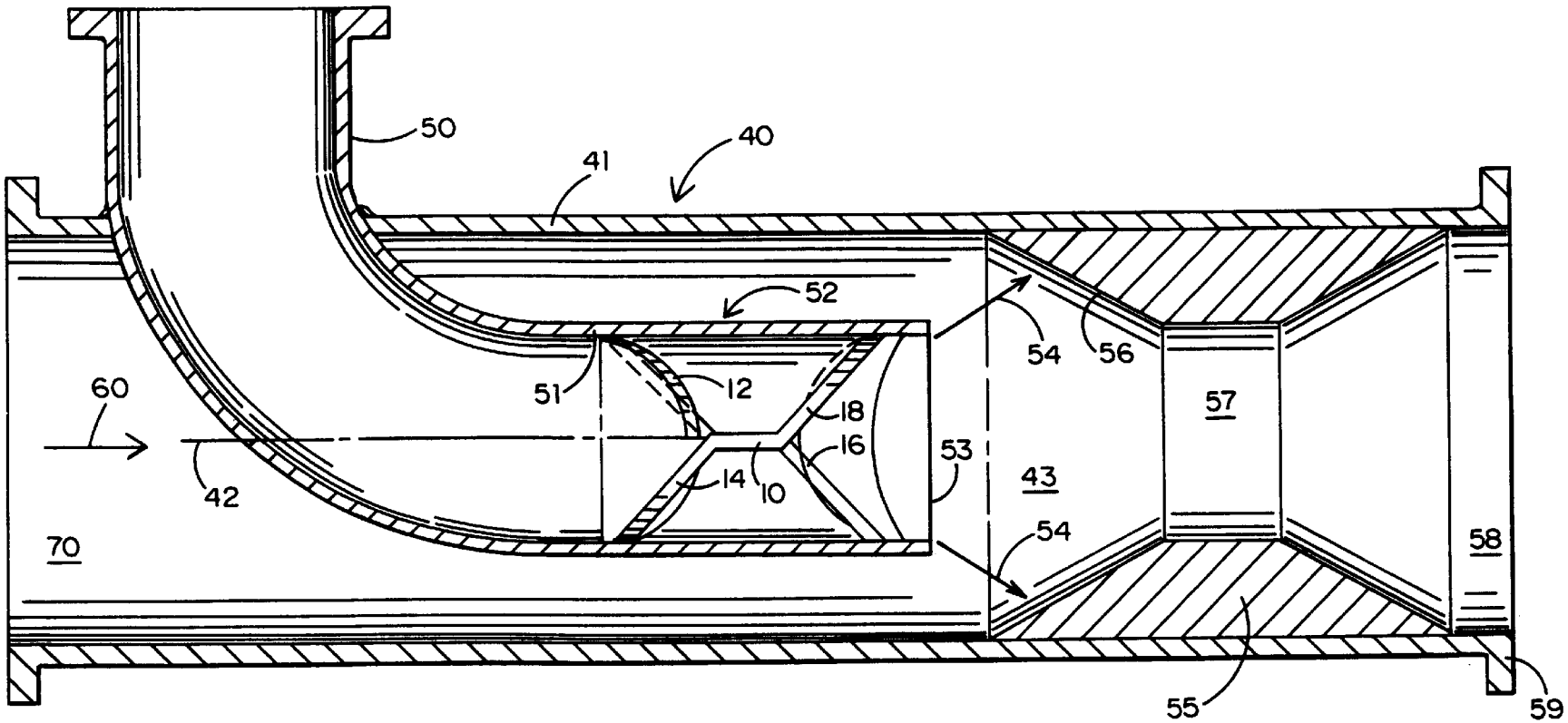
FIGS. 1, 2 and 3 are cross-sectional cutaway views of the device of the present invention.

The steam injection heater of the present invention can best be appreciated by viewing appended FIG. 1. At the outset, conduit 40 is provided for carrying a moving stream of liquid in the direction of arrow 60 from an upstream end 70 to a downstream end 58 defined by flange 59. Conduit 40 is provided with sidewall 41 defining a substantially circular cross-section having a longitudinal axis 42 substantially at the geometric center of said circular cross-section.

Figure 2:
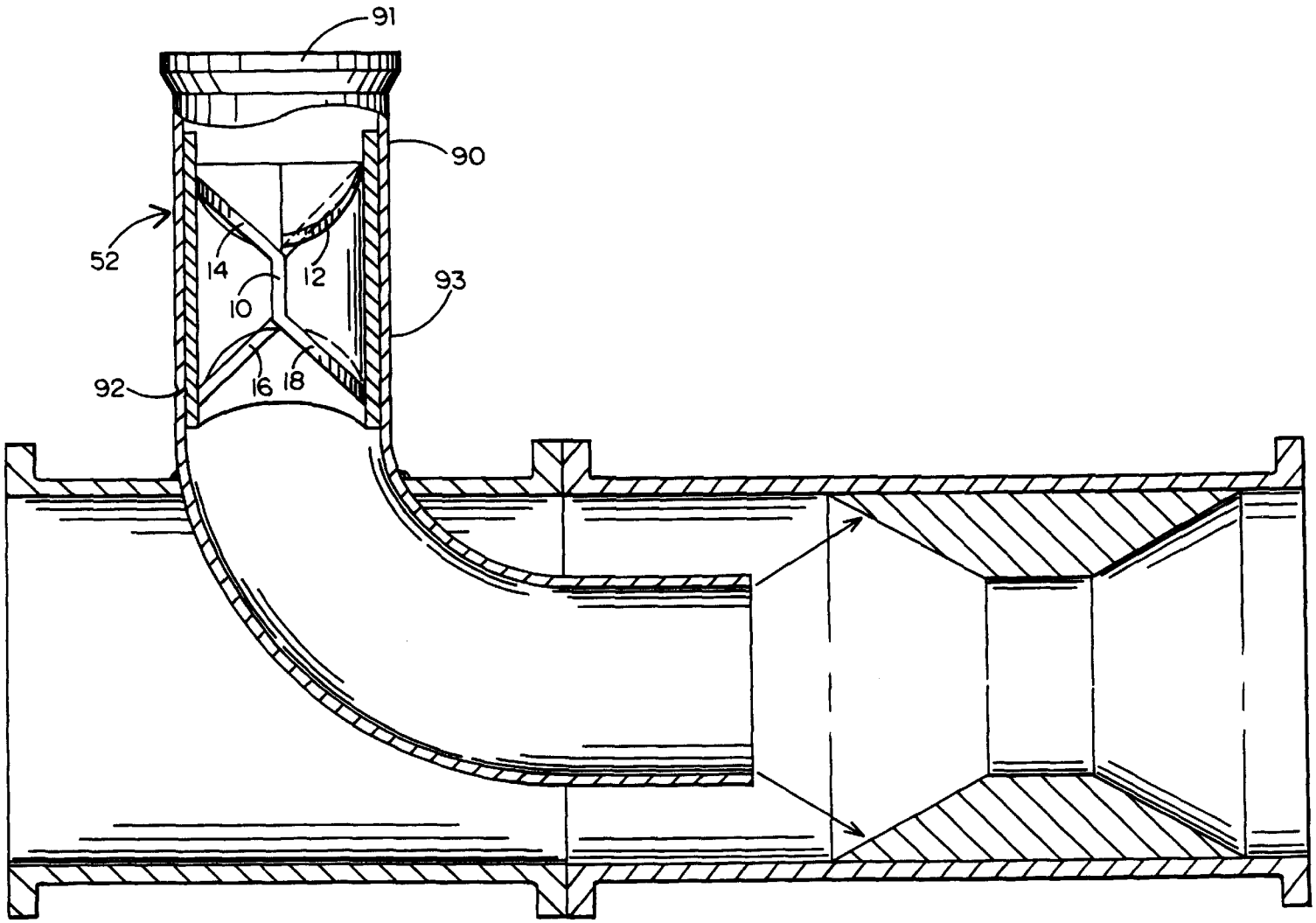

Conduit 40 is further defined as having ideally proximate its downstream end 58, tapered section 55 which effectively, through the use of sloping side walls 56, reduces the cross-section of conduit 40 to a smaller space 57 shown in FIGS. 1 and 2. Sloping side wall 56, in its preferred embodiment, extends from side wall 41 at an angle of approximately 30°.

Upstream of tapered section 55 is steam inlet pipe 50 defined by side wall 51 which passes through side wall 41 of conduit 40. As shown, steam inlet pipe 50 is designed to inject steam at its outlet end 53 in the direction of arrows 54 impinging upon the side walls of tapered section 55. Through the use of a judiciously selected mixing element 52, steam is caused to emanate from steam inlet pipe 50 at downstream end 53 as a rotating cone of steam for efficiently transferring heat energy from the steam to the moving stream of fluid.

As noted previously, the steam inlet pipe further includes a mixing element. Virtually any mixing element can be used which can cause steam emanating from the steam inlet pipe to do so in the form of a rotating cone. There are a number of commercially available spray nozzles that can be used for this purpose. The mixing element of U.S. Pat. No. 3,652,061, the disclosure of which is incorporated by reference, can also be employed.

As a preferred embodiment, applicant intends mixing element 52 to be of a specific configuration, that is, the mixing element disclosed in applicant's prior issued U.S. Pat. No. 3,923,288. Specifically, mixing element 52 includes a central flat rectangular central portion 10, the plane of which being intended to generally align within steam inlet pipe 50 along its longitudinal axis which ideally coincides with longitudinal axis 42 of conduit 40. First and second ears 12 and 14, rounded or otherwise configured at their outside peripheries for general fit to side wall 51 of steam inlet pipe 50 are bent upward and downward from rectangular flat portion 10. A second pair of ears 16 and 18 at the opposite side of flat portion 10 are bent downwardly and upwardly, respectively. The outside peripheral edges of ears 16 and 18 are also rounded or otherwise configured for a general fit to side wall 51.

Element 52 may be formed from a single flat sheet by a punch press, for example. However, the invention is not intended to be limited to any particular manner of fabrication nor is the invention limited to providing element 52 as a unitary piece. For example, element 52 could be a plurality of pieces brazed, soldered, welded or otherwise fastened together.

The angle between ears 12–14 and 16–18 is preferably in the range of about 30° to 120°. In operation, for steam moving within steam inlet pipe 50, element 52 imposes a counter-clockwise velocity vector both before flat portion 10 and subsequent to it as well as a substantially outwardly directed radial velocity vector. The result is that steam emanating from steam inlet pipe 50 at exit 53 rotates violently as a spinning cone of steam entering conduit 40. This cone impinges on angled faces 56 in the direction of arrows 54. It is speculated that heat energy from the steam to the fluids passing within conduit 40 within space 43 is efficient because all of the fluid product must pass through a conical steam wall or curtain to get to the tapered block and must thus contact and be impinged by the steam on the tapered surface 56 of the block. Further, the action of the rotation of the steam and liquid product carried within conduit 40 tends to smear or remove the asymmetrical nature of the product flow caused by the existence of the steam pipe side entering elbow.

As noted, the present invention is not only capable of the efficient transfer of heat energy from steam to a moving fluid but does so without the need to employ any moving parts or use of complex structural elements. As such, the present invention is capable of operating without service or maintenance for quite some time and is highly resistant to clogging which, as noted previously, can be a dominant consideration in the food processing industry where food products of a viscous and non-homogeneous consistency would tend to clog steam injection heaters of prior configuration.

FIG. 2 differs from FIG. 1 in the placement of element 52. As noted, element 52, in FIG. 2, is placed proximate inlet 91 of steam inlet pipe 90. Element 52 is maintained in position by configuring dimple 92 within side wall 93 of steam inlet pipe 90. By practicing the configuration shown in FIG. 2, element 52 can easily be reached by a technician and removed as the need arises.

Figure 3:
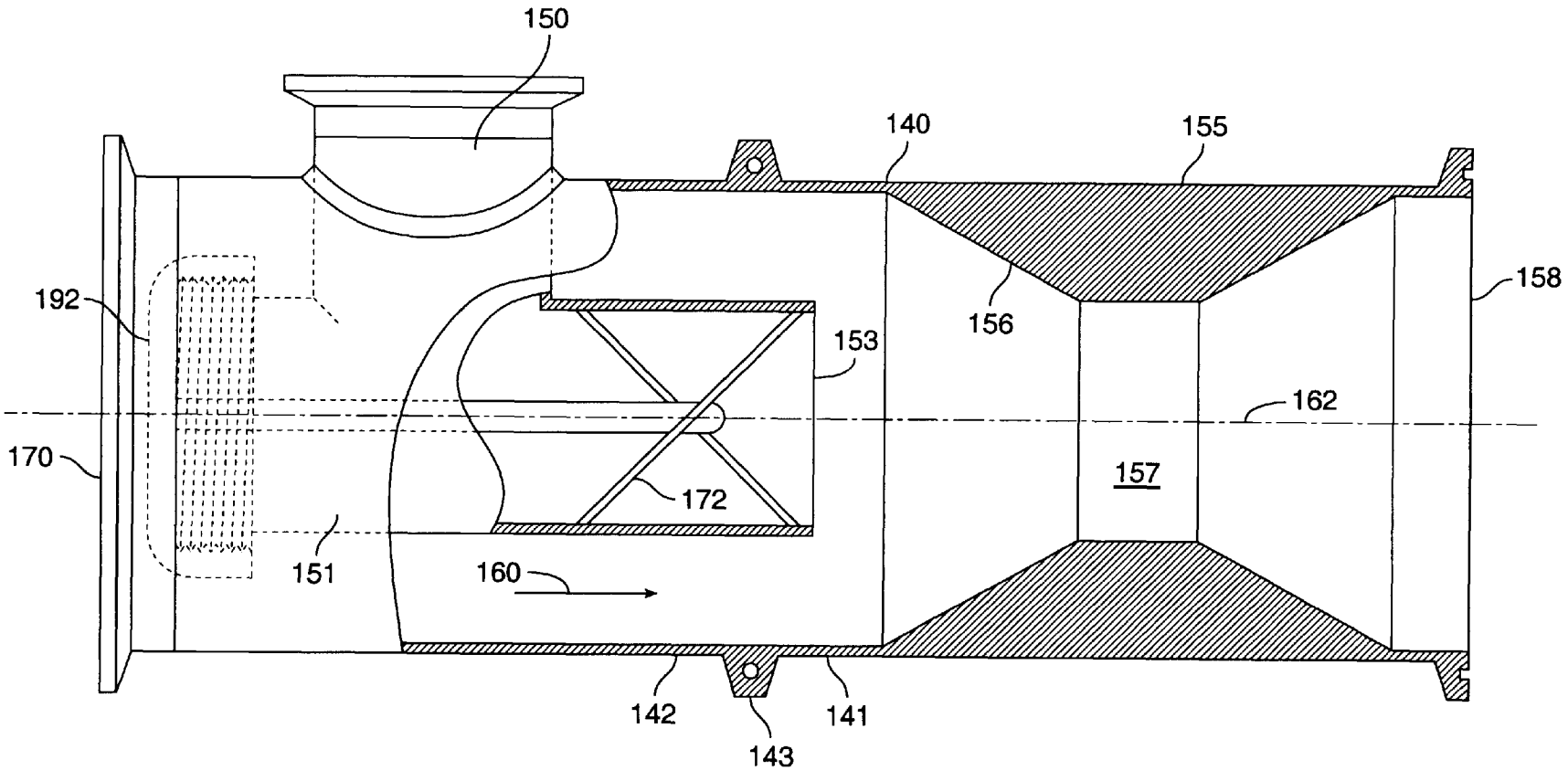

A third embodiment of the present invention is shown in FIG. 3 wherein conduit 140 is composed of segments 141 and 142 joined at flange 143. Conduit 140 is provided for carrying the moving stream of liquid in the direction of arrow 160 from an upstream end 170 to a downstream end 158. As in the previous embodiments, conduit 140 is defined by having a substantially circular cross-section and a longitudinal axis 162 substantially at the geometric center of said circular cross-section.

Conduit 40 is further defined as having proximate its downstream end 158 tapered section 155 which effectively, through use of sloping sidewalls 156, reduces the cross-section of conduit 140 to a smaller space 157 shown in FIG. 3. Sloping sidewalls 156, in its preferred embodiment, extends from the conduit sidewall at an angle of approximately 30°.

Upstream of tapered section 155 is steam inlet pipe 150 forming an elbow with pipe 151 which can be blocked at its upstream end by screw-on cap 152. Steam inlet pipe 150 is designed to inject steam at its outlet end 153 upon the sidewalls of tapered section 155. As was the case previously, mixing element 172 is placed within the steam inlet pipe which causes the steam to emanate from pipe 151 at outlet 153 as a rotating cone of steam for efficiently transferring heat energy from the steam to the moving stream of fluid.

In view of the foregoing, modifications to the disclosed embodiments within the spirit of the invention will be apparent to those of ordinary skill in the art. The scope of the invention is therefore to be limited only by the appended claims.

I claim:

1. A steam injection heater for liquids comprising a conduit for carrying a moving stream of liquids from an upstream end to a downstream end thereof, said conduit having a substantially circular cross-section and longitudinal axis and tapered section, said steam injection heater further comprising a steam inlet pipe passing through a side wall of said conduit for injecting steam at its outlet proximate the longitudinal axis of said conduit upstream of said tapered section, said steam inlet pipe further including a mixing element of a configuration to cause steam emanating from said steam inlet pipe to enter said conduit as a rotating cone of steam for efficiently transferring heat energy from said steam to said moving stream of liquids.

2. The steam injection heater of claim 1 wherein said tapered section of said conduit is characterized as having sloping side walls to reduce the diameter of said conduit within the tapered section.

3. The steam heater of claim 2 wherein the tapered section is characterized as having side walls which slope from the conduit side walls at approximately 30° angles.

4. The steam heater of claim 1 wherein said mixing element is characterized as having a flat rectangular central portion having first and second sets of ears adjacent opposite sides of said central portion, said sets of ears including first and second ears bent upward and downward relative to the plane of said central portion.

5. The steam heater of claim 4 wherein the included angle defined by said first set of ears is in the range of about 30° to about 120°.

6. The steam heater of claim 5 wherein the included angle defined by said second set of ears is in the range of about 30° to about 120°.

7. The steam heater of claim 1 wherein said tapered section is proximate the downstream end of said conduit.

* * * * *